United States Patent [19]

Simeth et al.

[11] 4,357,872

[45] Nov. 9, 1982

[54] ARRANGEMENT FOR REMOVAL OF DIRT OR OTHER IMPURITIES INTERFERING WITH THE INK FLOW FROM THE INK FOUNTAIN OF A PRINTING PRESS

[75] Inventors: Claus Simeth, Offenbach am Main; Erich Pietsch, Offenbach-Bieber

[73] Assignee: M.A.N.-ROLAND Druckmaschinen Aktiengesellschaft, Fed. Rep. of Germany

[21] Appl. No.: 227,376

[22] Filed: Jan. 22, 1981

Related U.S. Application Data

[63] Continuation-in-part of Ser. No. 218,823, Dec. 22, 1980, abandoned.

[30] Foreign Application Priority Data

Dec. 21, 1979 [DE] Fed. Rep. of Germany ..... 2951649

[51] Int. Cl.[3] ..... B41F 31/04; B41F 31/06; B41F 35/04; B41L 27/06

[52] U.S. Cl. ..... 101/350; 101/363; 101/365; 101/425

[58] Field of Search ..... 101/365, 363, 364, 350, 101/157, 168, 207, 208, 210, 423–425, 351, 352; 118/261

[56] References Cited

U.S. PATENT DOCUMENTS

| | | | |
|---|---|---|---|
| 2,078,520 | 4/1937 | Wolf | 101/365 |
| 2,623,461 | 12/1952 | McWhorter | 101/365 X |
| 2,691,344 | 10/1954 | McMullen | 101/425 |
| 3,037,451 | 6/1962 | Davis | 101/350 |
| 3,696,743 | 10/1972 | Johne et al. | 101/365 |
| 3,822,642 | 7/1974 | Grindeland | 101/425 |

FOREIGN PATENT DOCUMENTS

| | | | |
|---|---|---|---|
| 2344029 | 8/1973 | Fed. Rep. of Germany | 101/425 |

*Primary Examiner*—J. Reed Fisher

*Attorney, Agent, or Firm*—Leydig, Voit, Osann, Mayer & Holt, Ltd.

[57] ABSTRACT

An ink fountain for a printing press having a sub-frame which is mounted on the main frame of the press and which cooperates with a stationary fountain roller. A fountain blade is secured to the sub-frame with provision, interposed between the sub-frame and the blade, for establishing the thickness of ink film fed by the balde when the sub-frame occupies a reference position. The sub-frame has a hinge connection with the main frame for rocking movement about an axis remote from the tip of the blade between the reference position and a downwardly angled position in which an enlarged clearance gap is created at the tip of the blade, with the resulting rush of ink therethrough clearing the tip of the blade of contamination by accumulated particles of dirt or other impurities. A rotatable cam on the main frame having a plurality of similarly shaped lobes cooperates with a cam follower on the sub-frame so that when the cam is rotated the sub-frame oscillates back and forth between its reference position and its angled position. An auxiliary doctor blade is moveable into engagement with the fountain roller to divert the contaminated ink.

5 Claims, 1 Drawing Figure

Figure 1:
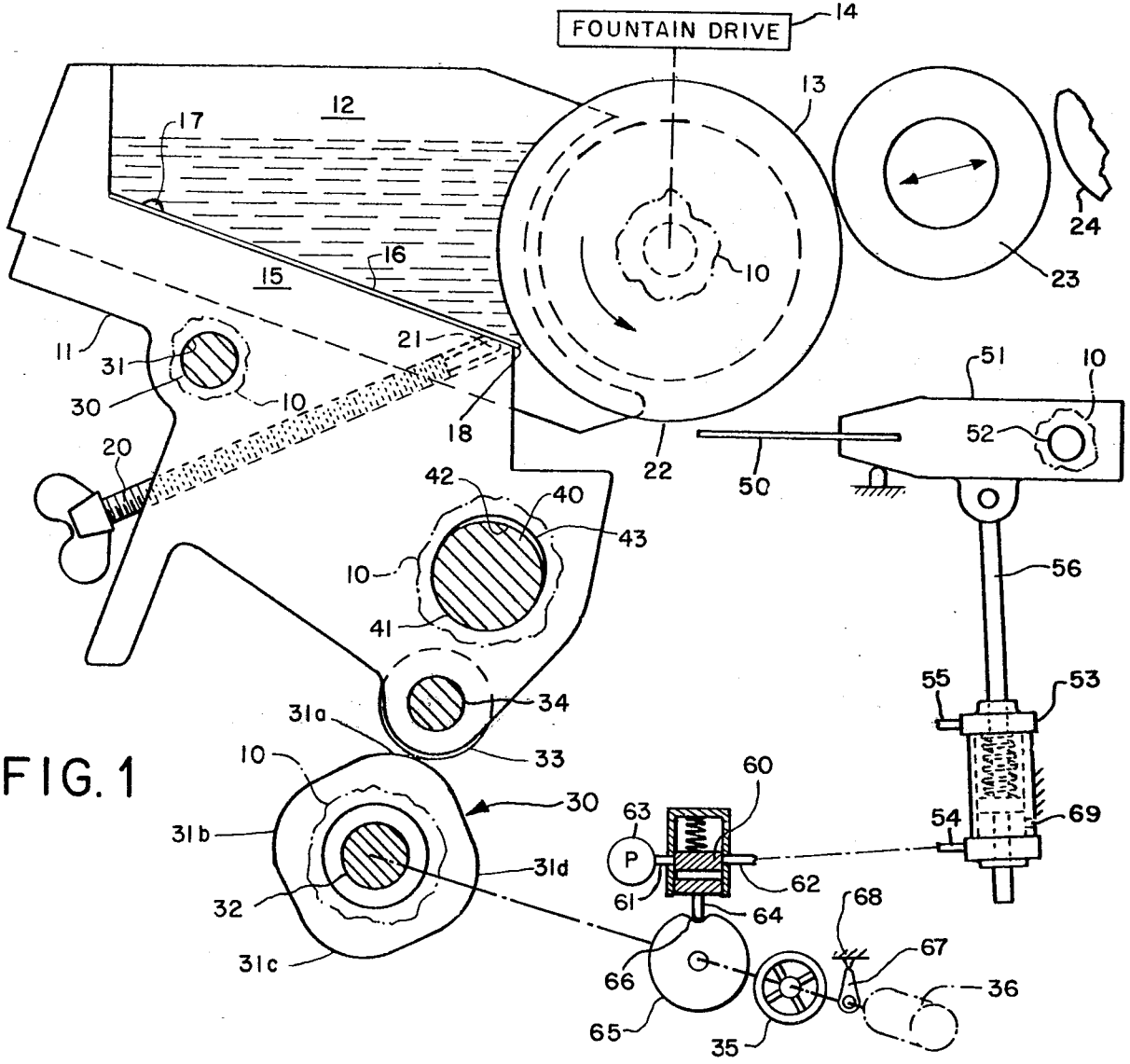

ARRANGEMENT FOR REMOVAL OF DIRT OR OTHER IMPURITIES INTERFERING WITH THE INK FLOW FROM THE INK FOUNTAIN OF A PRINTING PRESS

This is a continuation-in-part of application Ser. No. 218,823, filed Dec. 22, 1980, now abandoned.

In a conventional printing press employing an ink fountain, in which ink is metered by a fountain blade, contamination in the form of dirt, fibrous material and other impurities such as pieces of dried ink tend to clog the gap at the tip of the blade. Such impurities may not be present in the ink which is loaded into the fountain but tend to reach the fountain by working their way back through the distributor rollers which comprise the ink feeding system, particularly during long press runs. When such clogging occurs it is customary to either empty and clean the fountain or to temporarily increase the gap so that impurities are entrained by the ink flow, ink containing the impurities then being removed by hand from the fountain roller. Both procedures are time consuming and laborious. Where the gap is disturbed, considerable care and expertise must be employed to restore it to its original setting to reestablish the rate and distribution of ink flow.

It is, accordingly, an object of the present invention to provide an ink fountain for a printing press in which the frame, or base member, upon which the blade is mounted, and with reference to which it is set, is bodily shiftable between a reference position and an open position to form an enlarged clearance gap so that the resulting rush of ink clears the tip of the blade of contamination. It is a more specific object to make the frame of the fountain rockable about a hinge connection on the main frame of the press between a normal running position in which ink is fed through an adjustable gap and a downwardly angled position in which the gap is temporarily widened so that accumulated particles are pushed through the gap, with the contaminated ink being subsequently removed from the fountain roller by a temporarily interposed doctor blade.

Thus it is an object of the invention to provide a self-cleaning ink fountain construction which may be put into the cleaning mode to establish an enlarged clearance gap for the ink but which is automatically re-set to a precise original condition of adjustment. This makes it possible for the blade to be cleaned numerous times, if necessary, during the course of an extended press run without necessity for readjustment.

It is a related object of the invention to provide an ink fountain which not only permits the blade to be backed off for cleaning purposes without disturbing its original adjustment but which includes a provision for rapidly oscillating or vibrating the blade between its alternate positions thereby flushing and restricting the ink in a rapidly repeated cycle to shake loose any impurities which may be reluctant to leave the edge of the blade.

It is another object of the invention to provide means to insure that the contaminated ink released at the edge of the blade is diverted from the surface of the fountain roller for disposal and does not reach the ductor or other pick-up device cooperating with the fountain roller, thereby to insure that the dislodged impurities are not passed into the inking system.

It is a general object of the invention to provide a self-cleaning mechanism for an ink fountain in a printing press which may be easily operated without exercise of care or skill, which is economically constructed, and which may be employed both in new designs of printing presses and, by retrofit, in presses already in the field.

Other objects and advantages of the invention will be apparent upon reading the attached detailed description and upon reference to the drawing in which FIG. 1 is a vertical section, partly diagrammatic, taken through a fountain constructed in accordance with the invention.

While the invention has been described in connection with the preferred embodiment, it will be understood that there is no intention to limit the invention to the particular embodiment and that it is intended, on the contrary, to cover the various alternative and equivalent constructions included within the spirit and scope of the appended claims.

Turning to the drawing there is shown portions 10 of the main frame of a printing press having parallel frame plates. Arranged between the frame plates in an ink fountain which includes a sub-frame 11 defining an ink trough 12 containing a body of ink. Cooperating with the sub-frame is a fountain roller 13 which is stationarily journaled with respect to the frame 10 and which is positioned to form one side of the trough. The fountain roller is slowly rotated, in the direction of the arrow, by a fountain drive 14.

The fountain sub-frame 11 mounts, and in the present instance integrally includes, a base member 15. A fountain blade 16 is secured, for example, by means 17, to the base member 15 so that the blade is oriented in a shallow chordwise direction with respect to the fountain roller, with the tip 18 of the blade being spaced from the surface of the fountain roller.

Means are interposed between the base member and the blade for establishing the thickness of the ink film fed by the blade when the base member occupies the illustrated reference position. Such means is in the form of a set of adjusting screws 20, which only one is shown, having a tip 21 which engages the underside of the blade at spaced intervals. During normal operation of the fountain, a film of ink of predetermined thickness is fed past the tip 18 of the blade about a path of transport 22 for pick-up by a roller 23 which serves to pass the film to series of distributor rollers 24, only one of which is shown, which distribute and transmit the film to the surface of the plate on the plate cylinder (not shown). The pick-up roller 23 is preferably, but not necessarily, in the form of a ductor roller which is bodily oscillated back and forth between the two surfaces which it engages.

In accordance with the present invention, the frame 11 of the fountain, in which has been referred to as a sub-frame, or at least the base member 15 thereof, is mounted for shifting movement with respect to the main frame of the press between the illustrated reference position and an alternate position referred to for convenience as an "open" position, in which an enlarged clearance gap is created at the tip 18 of the blade. The opening of the gap combined with the resulting rush of ink therethrough, serves to clear the tip of the blade of contamination by accumulated particles of dirt or fibrous material without necessity for emptying the fountain of ink and without necessity for disturbing running adjustment of the blade.

For conveniently providing the shifting movement between the two alternate positions, the frame 11 of the fountain is preferably hinged to the main frame of the press along a hinge axis which is located remotely from, and parallel to, the tip of the fountain blade. In the present instance the hinge is formed by a hinge pin 30 which passes through an opening 31 formed in the frame of the fountain and which is secured at its ends to the main frame 10 of the press. The rocking movement of the frame 11 required to produce an enlarged clearance gap is, of course, quite limited.

In accordance with the present invention means are provided for establishing the limits of movement and for oscillating the sub-frame 11 between such limits. This is accomplished by using a multi-lobed rotatable cam 30 having lobes 31*a*–31*d* which are similarly shaped and which, in the present instance, are four in number. The rotatable cam 30 has a shaft 32 which is stationarily journaled in the main frame 10. The surface of the cam engages a cam follower in the form of a roller 33 which is secured to the frame of the fountain upon a pivot pin 34. For the purpose of rotating the cam 30 and hence oscillating the fountain frame at a rapid rate, a hand wheel 35 is provided, as shown diagrammatically in the drawing, and, if desired, the shaft 32 may be rotated more powerfully and rapidly by driving motor 36. The rapid oscillation is effective to shake free dirt and other impurities, particularly paper fibers, which might be reluctant to come loose, from the edge of the fountain blade. Cam follower 33 is kept in contact with the cam surface by the overhanging weight of the fountain frame about the hinge axis. However if desired this gravity bias may be augmented by a spring secured to the main frame of the press and urging the fountain frame in the clockwise direction as viewed in the drawing.

In carrying out the invention, the rocking movement of the fountain frame is preferably limited in each direction by positive stops. Such positive stops may be conveniently formed by a stop bar 40 which is secured at its ends to the main frame of the press and which provides a first stop surface 41 for establishing illustrated reference position of the fountain frame and a second stop 42 which establishes the angled, or open, position. The stop bar is telescoped through a transverse clearance opening 43 which extends through the fountain frame and which is oversize to a degree which permits the desired range of movement.

In accordance with one of the aspects of the present invention, means including a doctor blade are provided interposable in the arc of transport of the fountain roller to divert the contaminated ink released upon opening of the clearance gap. Such doctor blade, indicated at 50, is mounted upon a carrier lever 51 which is pivoted to the press frame at 52 and which is coupled to a stationarily mounted actuator 53 having a pressurized port 54 and an exhaust port 55 as well as a piston rod 56. Any means may be provided for applying pressurized air to the port 54 for raising the doctor blade into its operating position as long as contaminated ink is being released from the enlarged clearance gap.

However, in accordance with one of the aspects of the present invention it is preferred to provide automatic control means for simultaneously actuating the cam 30 and the doctor blade diverter 50. This is accomplished by providing a valve for pressurizing the actuator in which is opened automatically in response to departure of the fountain frame from its reference position. Thus we provide a valve 60 having an inlet 61 and outlet 62, the inlet being fed from a pressurized source 63. The valve includes a control plunger 64 which presses against a control cam 65 which is mounted upon the shaft 32 and which has a notch 66. The notch is so phased as to turn off the valve when the cam follower 33 is in engagement with a reference lobe on the cam, specifically the lobe 31*a*. The reference condition is conveniently indicated by providing a pointer 67 on the cam shaft which cooperates with a fixed index 68.

In operation, whenever the shaft 32 of the cam is rotated from its illustrated position, either by the handwheel 35 or by the power driven device 36, causing the fountain frame to rock into a downwardly angled position thereby to open an enlarged clearance gap at the end of the blade, the valve 60 is opened thereby automatically pressurizing the actuator 53 to bring the doctor blade 50 into contact with the fountain roller. The blade thus scrapes the contaminated ink from the roller before it has an opportunity to be transported to the conductor 23 and to the succession of inking rollers which supply the printing plate. Conversely, when the shaft 32 and the cams which it carries are restored to reference position, the valve plunger drops into the notch 66 turning off the flow. Preferably in the simplified control arrangement which has been described, there is provided, at the lower end of the actuator, a vent 69 which permits the plunger, upon cut-off of applied pressure, to drop to its lower, disengaging position. The aperture 69, which may be adjustable, has the advantage of providing a time delay, upon restoration of the normal gap, which is sufficient to insure that the doctor blade diverts all of the contaminated ink which may have been deposited on the fountain roller. Whether the oscillating means is operated manually or under power, it is simple and foolproof and does not require the exercise of care or skill.

In the preferred form of the invention, which has been illustrated, the entire fountain frame is rocked between limit positions. It will be understood however that it is not essential to rock the entire fountain frame and it will suffice to rock simply the base member 15 thereof to which the blade 16 is secured, and which carries the adjusting means 20, while leaving the remainder of the frame stationary with respect to the main frame of the press. Also while it is desired to mount the frame 11, or its base member, for rocking movement about a hinge axis, it will be apparent to one skilled in the art that the invention is not limited thereto and that the enlarged clearance gap at the tip of the blade may be brought about by lateral shifting movement of the fountain frame through a limited stroke.

Also while the ink metering element has been illustrated and described in terms of the fountain blade, it will be understood that the term fountain "blade" is a generic term which applies to any metering means which is manually adjustable either totally or in adjacent sections for the purpose of determining the rate of ink flow, regardless of thickness. Finally, while a thin scraper blade 50 is proposed for cleaning the contaminated ink from the surface of the fountain roller, it will be apparent that the cleaning element may take other specific forms consistent with the function being performed, and the term "doctor blade" shall therefore be understood to include any equivalent cleaning or scraping means.

We claim as our invention:

1. An ink fountain for a printing press having a main frame comprising, in combination, a fountain sub-frame defining a trough for containment of ink, a stationary fountain roller journalled with respect to the main frame in position to form one side of the trough, a fountain blade secured to the sub-frame for orienting the blade in a generally chordwise direction with the tip of the blade spaced from the surface of the fountain roller, means interposed between the sub-frame and the blade for establishing the thickness of the ink film fed by the blade when the sub-frame occupies a reference position, means for rotating the fountain roller slowly for conveyance of the ink film about an arc of transport, the sub-frame being mounted for rocking movement with respect to the main frame, means for establishing the limits of such movement between the reference position and a downwardly angled position in which an enlarged clearance gap is created at the tip of the blade with the resulting rush of ink therethrough serving to clear the tip of the blade of contamination by accumulated particles of dirt and fibrous material, means for oscillating the sub-frame between its reference position and its downwardly angled position, means including a doctor blade in the arc of transport movable between a retracted position and an intercepting position in which the doctor blade contacts the fountain roller to divert from the arc of transport the contaminated ink released from the clearance gap, control means for the oscillating means, and means operated automatically upon movement of the sub-frame from its reference position for moving the doctor blade to its intercepting position.

2. An ink fountain for a printing press having a main frame comprising, in combination, a fountain sub-frame defining a trough for containment of ink, a stationary fountain roller journalled with respect to the frame in position to form one side of the trough, a fountain blade secured to the sub-frame and oriented in a generally chordwise direction with the tip of the blade spaced from the surface of the fountain roller, means interposed between the sub-frame and the blade for establishing the thickness of the ink film fed by the blade when the sub-frame occupies a reference position, means for rotating the fountain roller slowly for conveyance of the ink film about an arc of transport, the sub-frame being mounted for rocking movement between its reference position and a downwardly angled position in which an enlarged clearance gap is created at the tip of the blade with the resulting rush of ink therethrough serving to clear the tip of the blade of contamination by accumulated particles of dirt and fibrous material, means for oscillating the sub-frame between is reference position and its angled position, the oscillating means including a rotatable cam on the main frame and a cam follower on the sub-frame, the cam having a plurality of similarly shaped lobes so that upon a single rotation of the cam the sub-frame is oscillated back and forth a plurality of times, a doctor blade in the arc of transport, the doctor blade being hinged to the main frame for movement between a retracted position and an intercepting position in contact with the fountain roller for diverting the contaminated ink released from the clearance gap, an actuator for moving the doctor blade to its intercepting position, and control means effective during a rotation of the cam for energizing the actuator so that the doctor blade remains in its intercepting position for a plurality of cycles of the oscillating means.

3. An ink fountain for a printing press having a main frame comprising, in combination, a fountain sub-frame defining a trough for containment of ink, a stationary fountain roller journalled with respect to the frame and positioned to form one side of the trough, a fountain blade secured to the sub-frame and oriented in a generally chordwise direction with the tip of the blade spaced from the surface of the fountain roller, means interposed between the sub-frame and the blade for establishing the thickness of the ink film fed by the blade when the sub-frame occupies a reference position, means for rotating the fountain roller slowly for conveyance of the ink film about an arc of transport, the sub-frame being mounted for rocking movement between its reference position and a downwardly angled position in which an enlarged clearance gap is created at the tip of the blade with the resulting rush of ink therethrough serving to clear the tip of the blade of contamination by accumulated particles of dirt and fibrous material, a doctor blade in the arc of transport, means for hingeing the doctor blade to the main frame for movement between an intercepting position for diversion of the contaminated ink released from the clearance gap and a retracted position, means for oscillating the sub-frame between its reference position and its downwardly angled position resulting in the rapid and repeated opening and closing of the clearance gap, an actuating mechanism for moving the doctor blade between its intercepting position and its retracted position, and control means for causing the actuating mechanism to move the doctor blade automatically into its intercepting position during the duration of oscillating movement of the sub-frame.

4. An ink fountain for a printing press having a main frame comprising, in combination, a fountain sub-frame defining a trough for containment of ink, a stationary fountain roller journalled with respect to the frame and positioned to form one side of the trough, a fountain blade secured to the sub-frame and oriented in a generally chordwise direction with the tip of the blade spaced from the surface of the fountain roller, means interposed between the sub-frame and the blade for establishing the thickness of the ink film fed by the blade when the sub-frame occupies a reference position, means for rotating the fountain roller slowly for conveyance of the ink film about an arc of transport, the sub-frame being hinged for rocking movement between its reference position and a downwardly angled position in which an enlarged clearance gap is created at the tip of the blade with the resulting rush of ink therethrough serving to clear the tip of the blade of contamination by accumulated particles of dirt and fibrous material, respective stops for establishing the reference position and angled position of the sub-frame, a doctor blade in the arc of transport having means for oscillating the same between an intercepting position in which the blade diverts the contaminated ink released from the clearance gap and a retracted position, actuator means for oscillating the sub-frame and actuating the doctor blade, and unitary control means for jointly operating the actuator means for the sub-frame and doctor blade so that the doctor blade is moved to its intercepting position when the sub-frame is moved to its downwardly angled position.

5. The combination as claimed in claim 1 or in claim 2 or in claim 3 or in claim 4 in which the sub-frame has an opening extending parallel to the axis of rocking movement and the main frame has secured thereto a bar extending through the opening, the opening being slightly oversized with respect to the bar so that the opposite edges on the bar serve as respective stops for limiting the oscillating movement of the sub-frame.

* * * * *